US005702267A

United States Patent [19]

Chen

[11] Patent Number: 5,702,267

[45] Date of Patent: Dec. 30, 1997

[54] STRUCTURE OF LAMP SOCKET

[76] Inventor: Ming-Hsiung Chen, 16, Alley 3, Lane 227, Nung-An St., Taipei City, Taiwan

[21] Appl. No.: 546,820

[22] Filed: Oct. 23, 1995

[51] Int. Cl.[6] ..... H01R 4/24

[52] U.S. Cl. ..... 439/419; 439/505; 439/506

[58] Field of Search ..... 439/395–404, 439/417, 419, 502, 505, 506, 529, 531, 575

[56] References Cited

U.S. PATENT DOCUMENTS

| | | | |
|---|---|---|---|
| 2,308,016 | 1/1943 | Mihalyi . | |
| 2,570,751 | 10/1951 | Benander . | |
| 2,636,069 | 4/1953 | Gilbert | 439/419 |
| 3,151,926 | 10/1964 | Schick et al. . | |
| 3,372,362 | 3/1968 | Schick | 439/419 |
| 3,601,767 | 8/1971 | Eckles | 439/419 |
| 3,716,818 | 2/1973 | Finkelstein . | |
| 3,936,122 | 2/1976 | Hagelberg . | |
| 4,222,623 | 9/1980 | Hultberg . | |
| 4,382,654 | 5/1983 | Schick . | |
| 5,051,877 | 9/1991 | Liao . | |
| 5,241,746 | 9/1993 | Herzog et al. . | |
| 5,380,215 | 1/1995 | Huang . | |
| 5,421,742 | 6/1995 | Huang | 439/419 |
| 5,439,389 | 8/1995 | Cheng et al. | 439/419 |
| 5,446,640 | 8/1995 | Lin | 362/487 |
| 5,474,467 | 12/1995 | Chen | 439/419 |
| 5,492,483 | 2/1996 | Cheng et al. | 439/339 |
| 5,531,609 | 7/1996 | Cheng et al. | 439/340 |

*Primary Examiner*—David L. Pirlot
*Attorney, Agent, or Firm*—Ladas & Parry

[57] ABSTRACT

A safety lamp socket in which the center metal contact plate is fastened to a first through hole on the socket body, having a flanged transverse head at one end fastened to a retaining groove inside the first through hole, a pointed upright tip disposed outside the first through hole for piercing the electric wire to make electrical contact with one conductor thereof, and a springy tail at an opposite end disposed inside the socket body and supported on at least one first inside projecting bearing portion inside the socket body for contact with the tip contact of the lamp bulb. The side metal contact plate is fastened to a second through hole on the socket body, having an angled stop portion stopped above the second through hole, a pointed upright tip disposed outside the second through hole for piercing the electric wire to make electrical contact with one conductor thereof, and a projecting strip obliquely upwardly raised from one side and suspended inside the socket body for contact with the ring contact of the lamp bulb.

3 Claims, 7 Drawing Sheets

STRUCTURE OF LAMP SOCKET

BACKGROUND OF THE INVENTION

The present invention relates to a lamp socket, and relates more particularly to an improved structure of the center metal contact plate and side metal contact plate which keep the lamp bulb positively electrically connected to the electric wire. The invention also provides an improvement of the clamping plate of the lamp socket which permits the lamp socket to be fastened to any of variety of supports such as tree twigs, tree branches, wall nails, flat supporting boards, gutters, the eaves, etc.

Regular lamp sockets for Christmas tree light sets are generally comprised of a socket body having a center metal contact plate, a side metal contact plate, and a socket cap fastened to the socket body to hold down the electrical wire against the center metal contact plate and the side metal contact plate. When the socket cap is fastened to the socket body, the pointed tips of the center metal contact plate and the side metal contact plate are forced to pierce the insulator of the electrical wire to make electrical contact with a respective conductor in the electric wire. In order to ensure a safe operation, "UL" issued a new standard code in 1993 to define standard specifications for the socket body, center metal contact plate, side metal contact plate, etc. The design and installation of the center metal contact plate and side metal contact plate is of great concern in the operation of the lamp socket. If the center metal contact plate and the side metal contact plate are displaced or forced to deform, an electrical contact error or an electrical shock may occur. However, because of manufacturing tolerance, the tip contacts of different lamp bulbs may have different shapes and heights. The ring contacts of different lamp bulbs may have different outer diameters (see FIG. 1). Therefore, an electrical contact error tends to occur when a different lamp bulb is installed. FIG. 2 shows a lamp socket according to the prior art, in which the center metal contact plate is made of substantially an L-shaped configuration having a fixed end fastened to the top wall of the socket body and a free end suspended inside the socket body in a horizontal position. The side metal contact plate has a fixed end fastened to the top wall of the socket body and a free end suspended inside the socket body in a vertical position. These metal contact plates fit tip contacts of different heights and ring contacts of different diameters. However, they tend to displace from free ends to cause short circuits when the lamp bulb is threaded into the socket body. FIG. 3 shows another structure of lamp socket in which the center contact metal plate is fixedly secured in place. The center metal contact plate has a contact portion in the middle smoothly curved downwards for contact with the tip contact of the lamp bulb. Because the two opposite ends of this structure of center metal contact plate are fixedly secured to the top side of the socket body, it will not return to its former lower position if it is forced upwards by a longer sized tip contact. Therefore, when a replaced lamp bulb having a shorter sized tip contact is fastened to the socket body, the tip contact may be unable to contact the center metal contact plate positively. The unstable contact between the center metal contact plate and the tip contact of the lamp bulb may produce high heat, or even causing the lamp socket to burn out. Furthermore, regular fixed type side metal contact plates, as shown in FIG. 4, commonly have at least one raised portion for contact with the ring contact of the lamp bulb. However, because the thickness of these fixed type side metal contact plates is about 0.4 mm, these fixed type side metal contact plates tend to be forced to deform. If a lamp bulb having a ring contact of relatively smaller outer diameter is used and is installed to replace a lamp bulb having a ring contact of relatively bigger outer diameter, an error or unstable contact between the ring contact of the lamp bulb and the side metal contact plate (see FIG. 5) may occur. Furthermore, regular lamp sockets generally have a hook or clamping plate on the outside for fastening to or hanging on a support. However, the hooks or clamping plates of regular lamp sockets can only be fastened to small supporting means. These hooks or clamping plates are not suitable for fastening to thick boards, the eaves, gutters, etc. If these hooks or clamping plates are stretched outwards in order to adapt a thick supporting means, they will deform and lose their springy force.

SUMMARY OF THE INVENTION

The present invention provides a lamp socket which eliminates the aforementioned drawbacks. It is therefore one object of the present invention to provide a fixedly mounted type center metal contact plate and side metal contact plate which enable the lamp socket to fit lamp bulbs of different sizes within manufacturing tolerances. It is another object of the present invention to provide a clamping plate which permits the lamp socket to be fastened to any of a variety of supporting means. According to one aspect of the present invention, the center metal contact plate is fastened to a first through hole on the socket body, having a flanged transverse head at one end fastened to a retaining groove inside the first through hole, a pointed upright tip disposed outside the first through hole for piercing the electric wire to make electrical contact with one conductor thereof, and a springy tail at an opposite end disposed inside the socket body and supported on at least one first inside projecting bearing portion inside the socket body for contact with the tip contact of the lamp bulb. The side metal contact plate is fastened to a second through hole on the socket body, having an angled stop portion stopped above the second through hole, a pointed upright tip disposed outside the second through hole for piercing the electric wire to make electrical contact with one conductor thereof, and a projecting strip obliquely upwardly raised from one side and suspending inside the socket body for contact with the ring contact of the lamp bulb. When the lamp bulb is threaded into the socket body, the springy tail of the center metal contact plate is forced upwards to a distance subject to the height of the tip contact. The projecting strip of the side metal contact plate is forced outwards by the ring contact of the lamp bulb. Therefore the center metal contact plate and the side metal contact plate will not be forced to displace upon the installation of the lamp bulb, and can be firmly maintained in contact with the tip contact and ring contact of the lamp bulb.

According to another aspect of the present invention, the socket cap has a curved clamping plate for fastening to a support. The curved clamping plate comprises a plurality of toothed portions, which face the periphery of said socket body, a second clamping portion defined on the inside for fastening to twigs, a bigger tree branch or the eaves, etc., and a first clamping portion defined on the outside between said curved clamping plate and said socket body for fastening to a tree branch, gutters, etc., a keyhole-like slot at one side for fastening to a nail on the wall.

DETAILED DESCRIPTION OF THE PREFERRED EMBODIMENT

Figure 1:
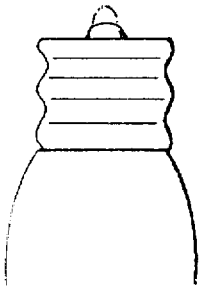
FIG. 1 PRIOR ART
FIG. 1 shows the different heights of the tip contact of a regular lamp bulb.
Figure 2:
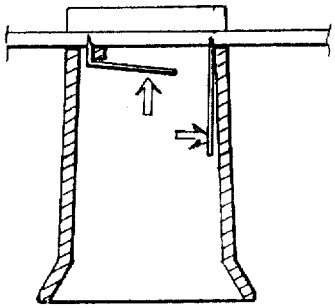
FIG. 2 PRIOR ART
FIG. 2 is a sectional view of a lamp socket according to the prior art, showing the center metal contact plate and the side metal contact plate suspended inside the socket body.
Figure 3:
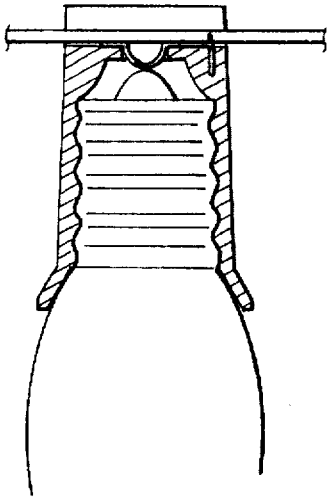
FIG. 3 PRIOR ART
FIG. 3 is a sectional view of another structure of lamp socket according to the prior art, showing the center metal contact plate fixedly secured inside the socket body.
Figure 5:
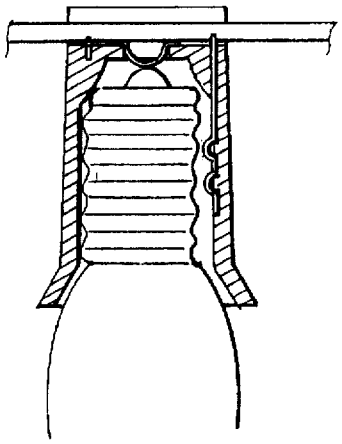
FIG. 5 PRIOR ART
FIG. 5 shows the unstable contact between the side metal contact plate and the lamp socket of FIG. 4.
Figure 4:
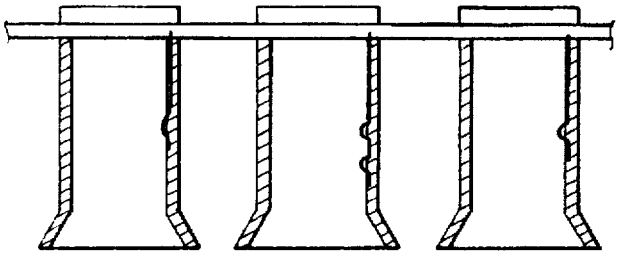
FIG. 4 PRIOR ART
FIG. 4 shows different side metal contact plates fixedly mounted inside different socket bodies according to the prior art.
Figures 6, 6A:
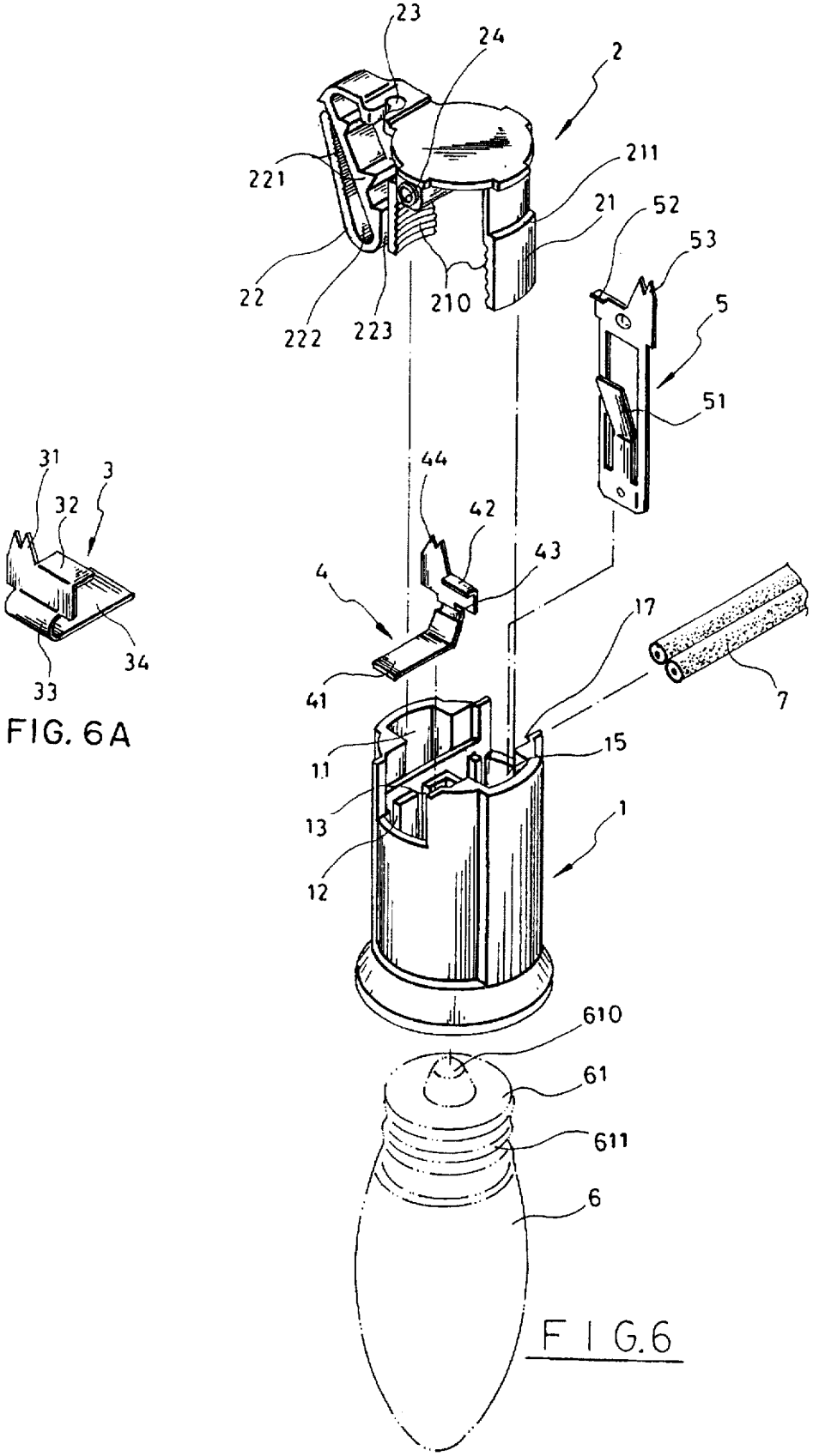
FIG. 6 is an exploded view of the lamp socket according to the present invention.
FIG. 6A shows an alternate form of the center metal contact according to the present invention.
Figure 7:
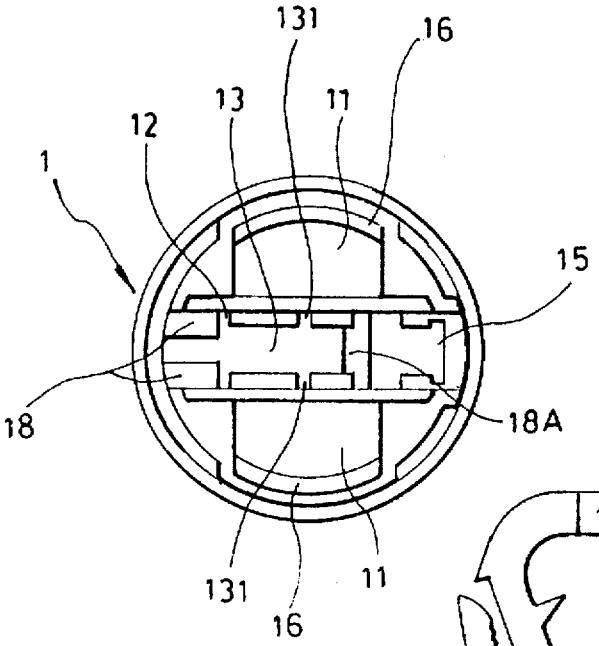
FIG. 7 is a top plain view of the socket body shown in FIG. 6.
Figure 12:
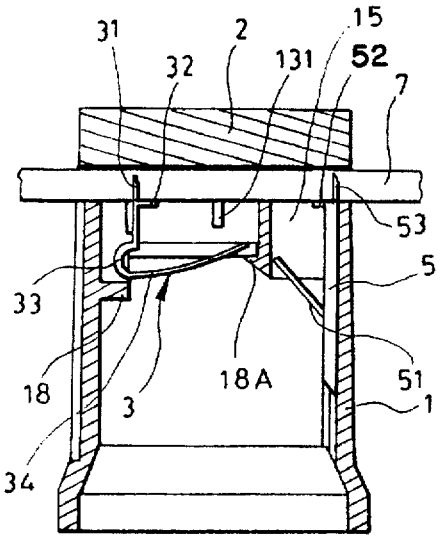
FIG. 12 is another sectional view of the lamp socket according to the present invention before the installation of the lamp bulb, showing the alternate form of the center metal contact of FIG. 6-1 installed.
Figure 13:
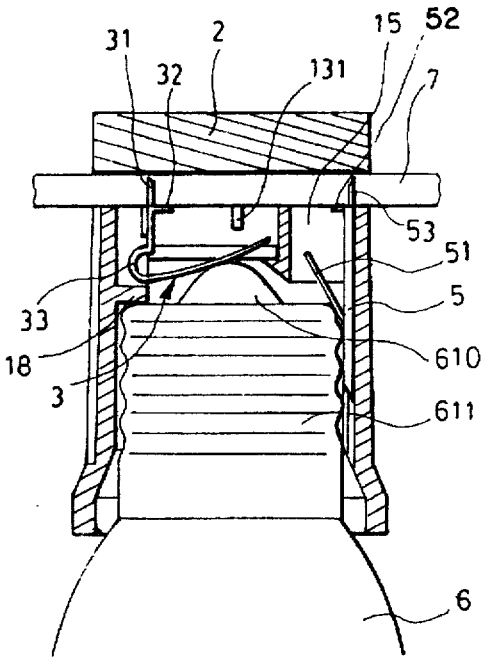
FIG. 13 is similar to FIG. 12 but showing the lamp bulb installed.
Figure 14:
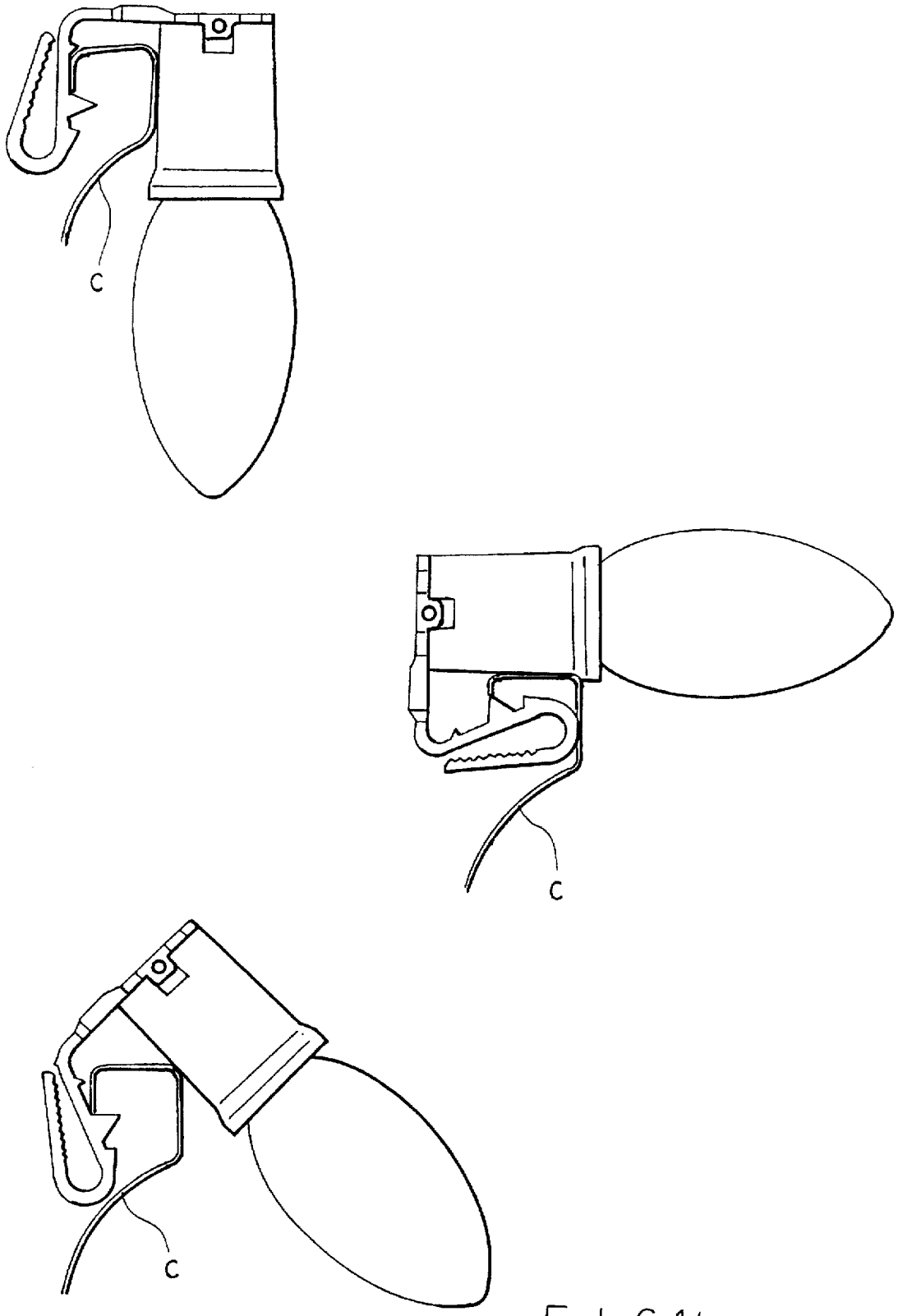
FIG. 14 shows the lamp socket fastened to a gutter at different angles according to the present invention.
Figure 15:
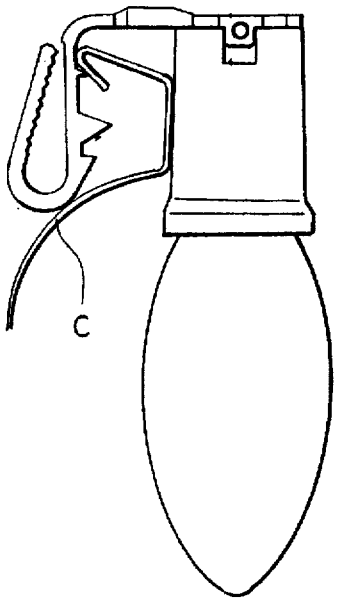
FIG. 15 shows the lamp socket fastened to another gutter at different angles according to the present invention.
Figure 15:
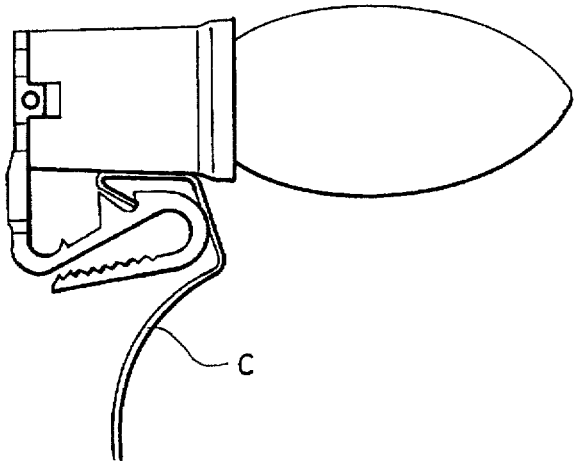
Figure 15:
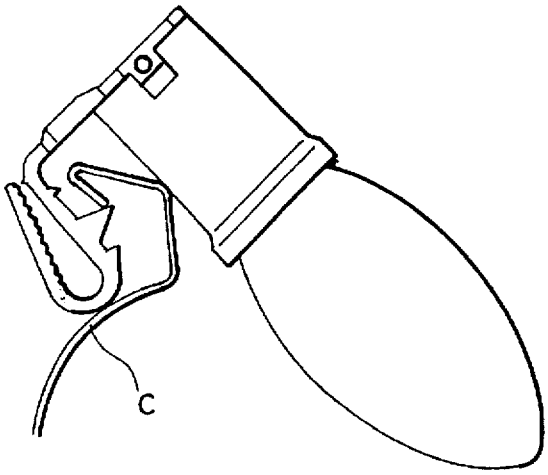
Figure 16:
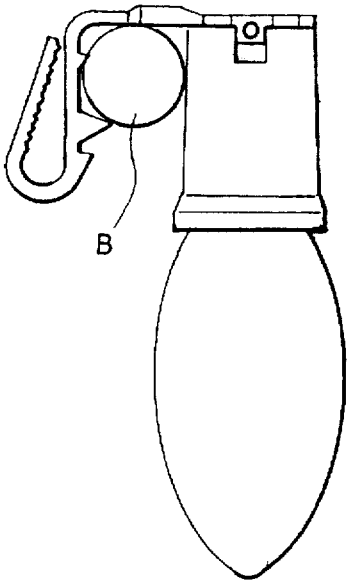
FIG. 16 shows the lamp socket fastened to a tree branch according to the present invention.
Figure 17:
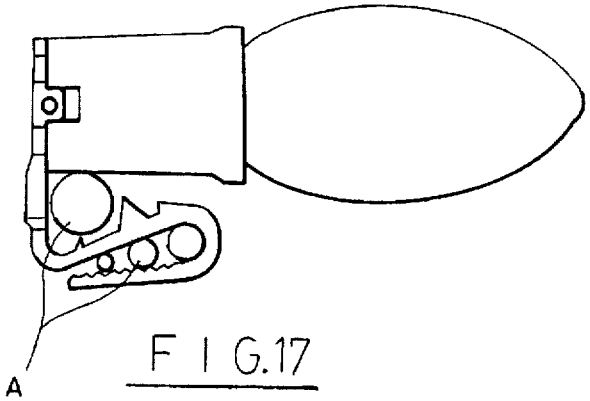
FIG. 17 shows the lamp socket fastened to tree twigs according to the present invention.
Figure 18:
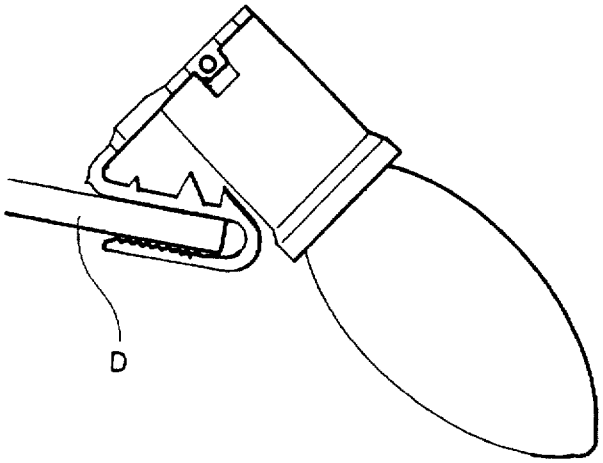
FIG. 18 shows the lamp socket fastened to the eaves according to the present invention.
Figure 19:
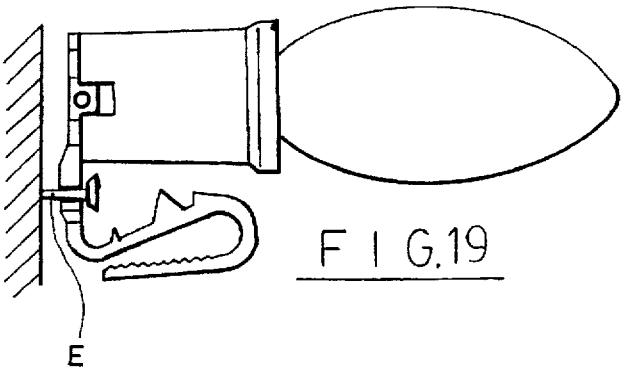
FIG. 19 shows the lamp socket fastened to a nail on the wall according to the present invention.

Referring to FIGS. 6, 6A, 7, 8, and 9, the socket body, referenced by 1, comprises a transverse wire groove 17 at the top side for mounting an electrical wire 7, two plug holes 11 at two opposite sides by the transverse wire groove 17, two inside projecting blocks 16 raised from the inside wall and respectively disposed below the plug holes 11, a first middle through hole 13 and a second middle through hole 15 spaced in the middle of the transverse wire groove 17 near two opposite ends, at least one first inside projecting bearing portion 18 and at least one second inside projecting bearing portion 18A. A center metal contact plate 4 is inserted into the the first middle through hole 13, having a flanged transverse head 42 at one end fastened to a retaining groove 131 inside the first middle through hole 13, a pointed upright tip 44 adjacent to the flanged transverse head 42 for piercing the electric wire 7 to make electrical contact with one conductor thereof, and a springy tail 41 at an opposite end disposed inside the socket body 1 and supported on the at least one first inside projecting bearing portion 18. A side metal contact plate 5 is inserted into the second middle through hole 15, having an angled stop portion 52 at the top stopped above the second middle through hole 15, a pointed upright tip 53 adjacent to the angled stop portion 52 for piercing the electric wire 7 to make electrical contact with one conductor thereof, and a projecting strip 51 obliquely upwardly raised from one side and suspending inside the socket body 1. FIG. 6-1 shows an alternate form of the center metal contact plate. This alternate form of center metal contact plate, referenced by 3 is made substantially L-shaped for fastening to a retaining groove 12 inside the first middle through hole 12, having a pointed upright tip 31 at the top protruding over the transverse wire groove 17 for piercing the electrical wire 7 to make electrical contact with one conductor of the electrical wire 7, a horizontal contact base 34 at the bottom side supported on the at least one second inside projecting bearing portion 18A for contact with the tip contact 610 of the lamp bulb 6, a horizontal stop portion 32 at the top side stopped above the first middle through hole 12, and an arched portion 33 connected between the horizontal contact base 34 and the horizontal stop portion 32 (see FIGS. 12 and 13). The design of the arched portion 33 greatly improves the springy power of the center metal contact plate 3.

The socket cap 2 is fastened to the socket body 1 to hold down the electrical wire 7. As illustrated, the socket cap 2 comprises a bottom pressure block 24 in the middle for holding down the electrical wire 7, two downward plugs 21 at two opposite sides for mounting in the plug holes 11 of the socket body 1, and a curved clamping plate 22 raised from the periphery. Each of the downward plugs 21 has a step 211 at an outer side for engaging with projecting blocks 16 of the socket body 1, and a threaded portion 210 at an inner side for engaging the ring contact 611 of the base 61 of the lamp bulb 6. The curved clamping plate 22 has a plurality of toothed portions 221, which face the periphery of the socket body 1 when the socket cap 2 is installed, and a keyhole-like slot 23 at one side.

Figure 9:
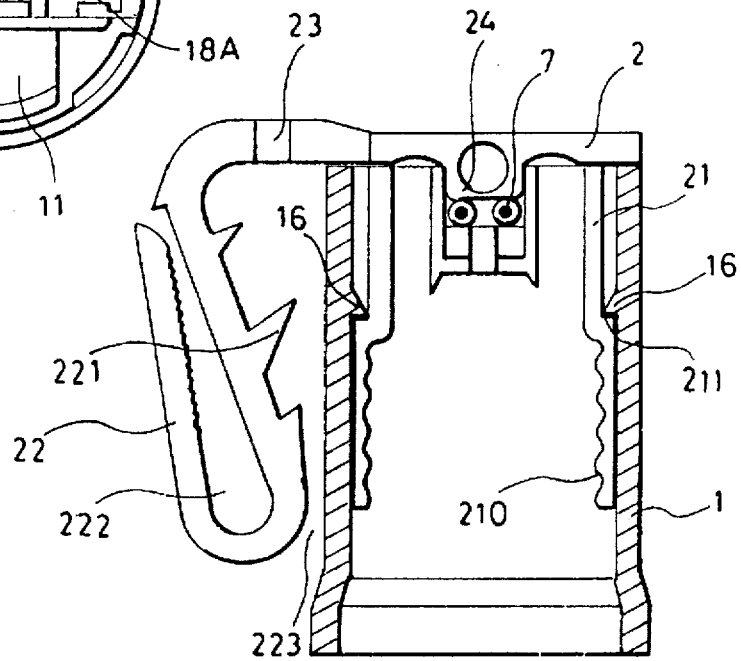
FIG. 9 is a sectional view showing the socket cap fastened to the socket body according to the present invention.
Figure 8:
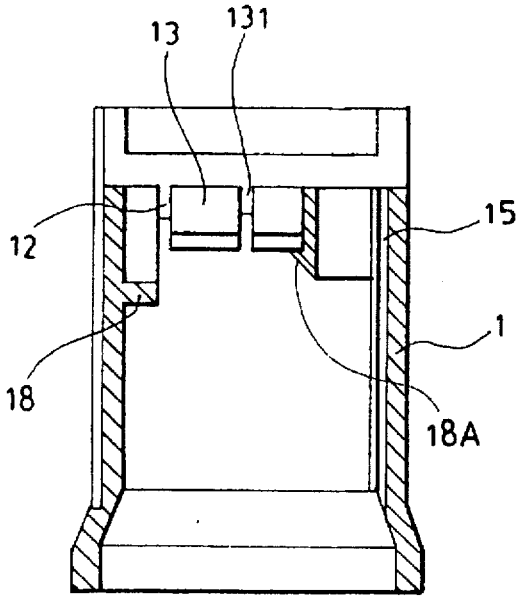
FIG. 8 is a longitudinal view in section of the socket body shown in FIG. 6.
Figure 10:
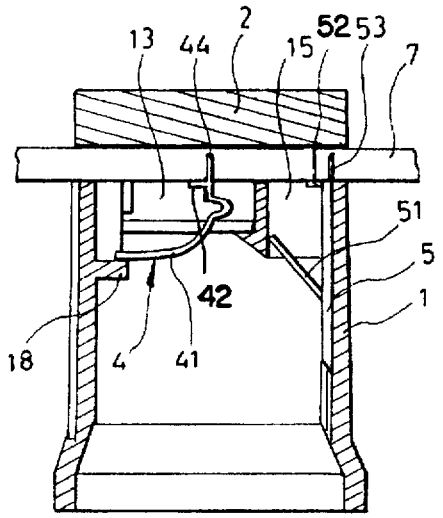
FIG. 10 is another sectional view of the lamp socket according to the present invention before the installation of the lamp bulb.
Figure 11:
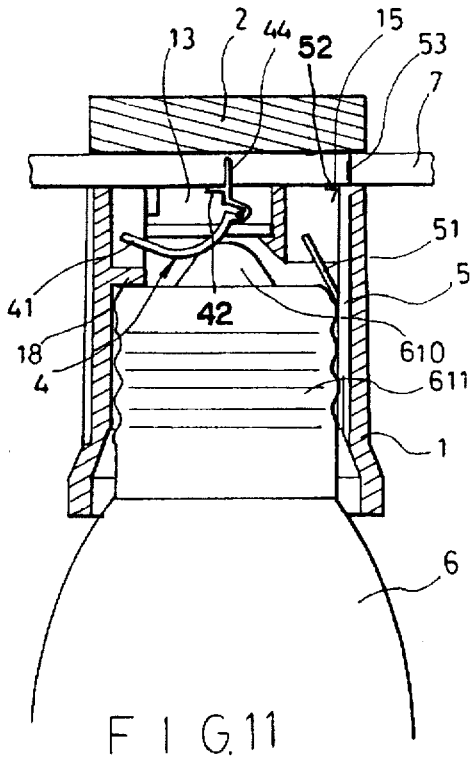
FIG. 11 is similar to FIG. 10 but showing the lamp bulb installed.

Referring to FIGS. 9, 10, and 11, when the electrical wire 7 is mounted in the wire groove 17, the socket cap 2 is fastened to the socket body 1 to hold down the electrical wire 7 by inserting the downward plugs 21 into the plug holes 11 for permitting the steps 211 of the downward plugs 21 to be respectively engaged with the projecting blocks 16 at the bottom. When the socket cap 2 is installed, the electrical wire 7 is forced by the pressure block 24 against the pointed upright tips 44 and 53 of the center metal contact plate 4 and the side metal contact plate 5, thereby rendering the pointed upright tips 44 and 53 to pierce the insulator of the electrical wire 7 and to make electrical contact with a respective conductor of the electrical wire 7. When the base 61 of the lamp bulb 6 is threaded into the socket body 1, the ring contact 611 of the base 61 is also threaded into engagement with the threaded portions 210 of the downward plugs 21 of the socket cap 2, the springy tail 41 of the center metal contact plate 4 is forced upwards by the tip contact 610 of the base 61 and retained in contact with it, and the projecting strip 51 of the side metal contact plate 5 is forced backward by the ring contact 611 of the base 61 and retained in contact with it, and therefore the lamp bulb 6 is electrically connected to the electrical wire 7. When the lamp bulb 6 is removed from the socket body 1, the springy tail 41 of the center metal contact plate 4 and the projecting strip 51 of the side metal contact plate 5 automatically return to their former positions.

Referring to FIGS. 14 to 19, through the curved clamping plate 22, the lamp socket can be installed in any of a variety of support means. As illustrated in FIG. 6, the curved clamping plate 22 further comprises a first clamping portion 223 on the outside, which is defined within the curved clamping plate 22 and the socket body 1, and a second clamping portion 222 on the inside, which is defined by the curved clamping plate 22 itself. By means of the first clamping portion 223 and the toothed portions 221, the lamp socket can be fastened to any of a variety of gutters C (see FIGS. 14 and 15) or a tree branch B (see FIG. 16). By means of the second clamping portion 222 and the toothed portions 221, the lamp socket can be fastened to different tree twigs A (see FIG. 17), or the eaves D (see FIG. 18). By means of the keyhole-like slot 23, the lamp socket can be fastened to the wall by a nail E (see FIG. 19).

It is to be understood that the description and corresponding drawings are designed for purposes of illustration only, and are not intended as a definition of the limits and scope of the invention disclosed.

I claim:

1. A lamp socket comprising a socket body to hold a lamp bulb, an electric wire fastened to a top transverse wire groove on said socket body, a center metal contact plate and a side metal contact plate respectively fastened to a first through hole and a second through hole on said socket body, and a socket cap fastened to said socket body to hold down said electric wire, causing said center metal contact plate and said side metal contact plate to make electrical contact with a respective conductor of said electric wire, wherein: said center metal contact plate has a flanged transverse head at one end fastened to a retaining groove inside said first through hole, a pointed upright tip adjacent to said flanged transverse head for piercing the electric wire to make electrical contact with one conductor thereof, and a springy tail at an opposite end disposed inside said socket body and supported on at least one first inside projecting bearing portion inside said socket body for contact with the tip contact of the lamp bulb in said socket body; said lamp cap including a bottom pressure block pressed against said electrical wire, two downward plugs at two opposite sides respectively inserted into a respective plug hole on said socket body, and a curved clamping plate raised from the periphery of the socket body, each downward plug having a step at an outer side engaged with a respective projecting block inside said socket body and a threaded portion at an inner side for engaging the ring contact of the lamp bulb, said curved clamping plate including a plurality of toothed portions, which face the periphery of said socket body, a second clamping portion defined on an inner side for fastening to a tree twig, a bigger tree branch or eaves, etc., and a first clamping portion defined outside the socket body between said curved clamping plate and said socket body for fastening to a tree branch, a gutter, etc., and a keyhole-like slot at one side for fastening to the wall by a nail.

2. The lamp socket of claim 1 wherein said side metal contact plate has an angled stop portion stopped above said second through hole, a pointed upright tip adjacent to said angled stop portion for piercing the electric wire to make electrical contact with one conductor thereof, and a projecting strip obliquely upwardly raised from one side thereof and suspended inside said socket body for contact with the ring contact of the lamp bulb upon its installation in said socket body.

3. The lamp socket of claim 1 wherein said center metal contact plate is made in the form of a substantially L-shaped configuration having a pointed upright tip at the top protruding over said first through hole for piercing said electrical wire to make electrical contact with one conductor thereof, a horizontal contact base at a bottom side supported on at least one second inside projecting bearing portion inside said socket body for contact with the tip contact of the lamp bulb, a horizontal stop portion stopped above said first through hole, and an arched portion connected between said horizontal contact base and said horizontal stop portion.

* * * * *